US007894731B2

(12) United States Patent
Jugle et al.

(10) Patent No.: US 7,894,731 B2
(45) Date of Patent: Feb. 22, 2011

(54) METHOD BY WHICH AN INFINITE NUMBER OF COLORS MAY BE USED WITH A FINITE NUMBER OF CCUS

(75) Inventors: Kip L. Jugle, Bloomfield, NY (US); James A Winters, Alfred Station, NY (US); Mark A Scheuer, Williamson, NY (US)

(73) Assignee: Xerox Corporation, Norwalk, CT (US)

( * ) Notice: Subject to any disclaimer, the term of this patent is extended or adjusted under 35 U.S.C. 154(b) by 342 days.

(21) Appl. No.: 12/197,619

(22) Filed: Aug. 25, 2008

(65) Prior Publication Data

US 2010/0046972 A1 Feb. 25, 2010

(51) Int. Cl.

| | |
|---|---|
| ***G03G 15/00*** | (2006.01) |
| ***G03G 15/01*** | (2006.01) |
| ***G03G 15/08*** | (2006.01) |
| ***G03G 15/10*** | (2006.01) |

(52) U.S. Cl. ..... 399/38; 399/39; 399/53; 399/54; 399/58; 399/61; 399/62; 399/252; 399/253; 399/254

(58) Field of Classification Search ..... 399/38, 399/39, 53, 54, 58, 61, 62, 252–254
See application file for complete search history.

(56) References Cited

U.S. PATENT DOCUMENTS

| | | | | |
|---|---|---|---|---|
| 4,998,145 | A | 3/1991 | Haneda et al. | |
| 5,270,769 | A | 12/1993 | Satoh et al. | |
| 5,313,259 | A | 5/1994 | Smith | |
| 6,418,286 | B1 | 7/2002 | Hou | |
| 2006/0060260 | A1 * | 3/2006 | Amano et al. | 141/83 |
| 2006/0159485 | A1 * | 7/2006 | Nishimura et al. | 399/109 |
| 2009/0003889 | A1 * | 1/2009 | Itabashi | 399/281 |

* cited by examiner

*Primary Examiner*—David P Porta
*Assistant Examiner*—Mindy Vu
(74) *Attorney, Agent, or Firm*—Ronald E. Prass, Jr.; Prass LLP

(57) ABSTRACT

A method of changing a color developer in a developer housing of xerographic marking system are disclosed, and may include supplying a chart divided into a plurality of color family sections or quadrants, selecting a new color to be installed in a developer housing corresponding to the color family section, purging old toner from the developer housing until a concentration of old toner is reduced to about 0.1% to 6.0% from its nominal concentration, installing a container of a new color developer in the developer housing, and running the marking system until the required concentration of the new color developer is attained.

14 Claims, 3 Drawing Sheets

METHOD BY WHICH AN INFINITE NUMBER OF COLORS MAY BE USED WITH A FINITE NUMBER OF CCUS

This invention relates to an electrostatic or xerographic marking system and, more specifically, to a developing unit or station of such a system.

BACKGROUND

In xerography or an electrostatographic process, a uniform electrostatic charge is placed upon a photoreceptor surface. The charged surface is then exposed to a light image of an original to selectively dissipate the charge to form a latent electrostatic image of the original. The latent image is developed by depositing a liquid developer or finely divided and charged particles of toner upon the photoreceptor surface. The charged toner being electrostatically attached to the latent electrostatic image areas creates a visible replica of the original. The developed image is then usually transferred from the photoreceptor surface to a final support material such as paper and the toner image is fixed thereto to form a permanent record corresponding to the original.

In xerographic color copiers using a dry toner or liquid toner system, a photoreceptor surface is generally arranged to move in an endless path through the various processing stations of the color xerographic process. The color toner image is then transferred from the photoreceptor to a final support material such as paper and the surface of the photoreceptor is prepared to be used once again for the reproduction of a copy of a colored original. In this endless path, several stations, including color toner and development stations, are traversed. These stations generally involve one color toner dispensing unit in each development station. The present invention and embodiments are used in both dry ink systems and liquid printing systems.

In today's complex color systems (including printers and copiers), several potential problems need to be addressed and controlled. For example, space and apparatus size must be minimized including the size and life of color stations.

In current highlight color printer architecture, a color is unique to a customer-changeable unit or CCU (developer hardware). A customer requiring 10 colors would require 10 CCUs, 100 colors would require 100 CCUs and so on. As the number of available colors increases, then so does the number of CCUs. This becomes very expensive to the customer who wishes to print several colors or to the customers wishing to print a color only once.

If a customer today requires a different color in a color family, i.e. a darker orange rather than the orange color he or she presently has, the customer must purchase a new developer unit or CCU. Each unit costs several thousand dollars and changing color thereby can become costly and time consuming.

The present invention provides an easy procedure with a substantial savings to a customer wishing to change a color or colors in his color copier or printer.

SUMMARY

Rather than in the prior art supplying a unique set of developer housing or hardware (CCU) per color, it is herein provided that the color space is divided into quadrants or sections of similar hue angle or color family. Within each quadrant, the hardware of this is universal to all the color contained within that space. A color change algorithm will be executed to convert the housing from its current color to its next color. The quadrant size shall be an outcome of the efficiency and effectiveness of the color change algorithm. The greater the capability of the color change algorithm, the larger the quadrants and therefore less hardware sets or CCUs are required. The present embodiments enable a minimum number of developer hardware while still allowing all colors in the color gamut space.

The customer can change colors within a certain area without the added substantial expense of a new developer housing, (CCU) and toner dispenser system. This will increase the number of customer colors and provide customers the flexibility of quickly changing colors. In one embodiment, the customer also would only need to maintain a maximum of 12 housings for any number of colors. This process will use more of the customer's toner. It will use enough so that the customer won't be doing daily color changes in a single housing. The toner that is left in the toner dispense system is close to 1.5 pounds which is worth some small amount of money to the customer. This is cheaper than the current need of new housing, toner dispense and CCU cart which is several thousand dollars. The customer will need significantly less floor space for the CCU carts which includes housing and toner dispense. The customer only needs to order new toner if the color falls within the gamut or color family of existing housing. Increased customer satisfaction and savings allows the customer to go after smaller jobs because it is not necessary to offset the high cost of each replacement CCU. Also, the field service organization will need to maintain significantly less developer hardware in the customer site. The color change will not generate a service call (now handled by the customer). Increased page volumes are possible because the customer can go after smaller jobs with different colors as it is not necessary to offset the CCU cost.

As above stated, in the current highlight color printer architecture, a color is unique to a CCU (developer hardware). A customer requiring 10 colors would require 10 CCUs, 100 colors would require 100 CCUs and so on. This becomes very expensive to the customer who wishes to print several colors or to the customers wishing to print a color only once. This ID proposes that, rather than supplying a unique set of developer hardware per color, the color space be divided into quadrants of similar hue angle or color families. Within each sector, the hardware is universal to all colors contained within that space. A color change algorithm would be executed to convert the housing from its current color to its next color. The sector size would be an outcome of the efficiency and effectiveness of the color change algorithm. The greater the capability of the color change algorithm, the larger the sectors and therefore the lower number of hardware sets. The concept enables a minimum number of developer hardware while still allowing all colors in the color gamut space.

The process of this invention comprises the following:

After the old toner bottle is removed, the customer runs a special diagnostic routine that affects the color change by:

setting the machine control switches such that some of the xerographic process controls are turned off.

1. instructs the customer to install the new toner bottle and enter the toner color
2. checks the old vs. new toner colors on the chart of FIG. 2 to ensure compatibility with the exchange process or color family.
3. runs a high area coverage canned image to reduce the old toner concentration to less than 1% tc.
4. tones up the housing using the new color to a nominal tc (say 6%) (assuming the system started at 6% with the old color, this process is 83% effective in replacing the color) Steps 4 and 5 are repeated driving the new toner to a concentration of 97.22% (35 parts in 36). If needed, steps 4 and 5 can be repeated again to drive the new toner to a concentration of 99.53% (215 parts in 216). Each iteration uses ~125 grams of new toner for a sump size of 2500 grams for this example but this is substantially less expensive than replacing a very costly CCU.

A spectrophotometer is used to confirm the new color is present in the developer hardware or stations. While a spectrophotometer is preferred to confirm the required color, it could also be confirmed by visual inspection.

There are known different architectures and systems for multi-color electrostatic marking machines such as those described in U.S. Pat. Nos. 4,998,145; 5,270,769; 5,313,259 and 6,418,286. Each of these systems can use the method and system of the present invention. Each of these listed U.S. patents are incorporated by reference into the present disclosure. A typical marking system usable in the present invention system is illustrated in FIG. 1. This is by way of illustration and not limitation since any marking system having a color development station or stations can use the system of the present invention.

DETAILED DISCUSSION OF DRAWINGS AND PREFERRED EMBODIMENTS

Figure 1:
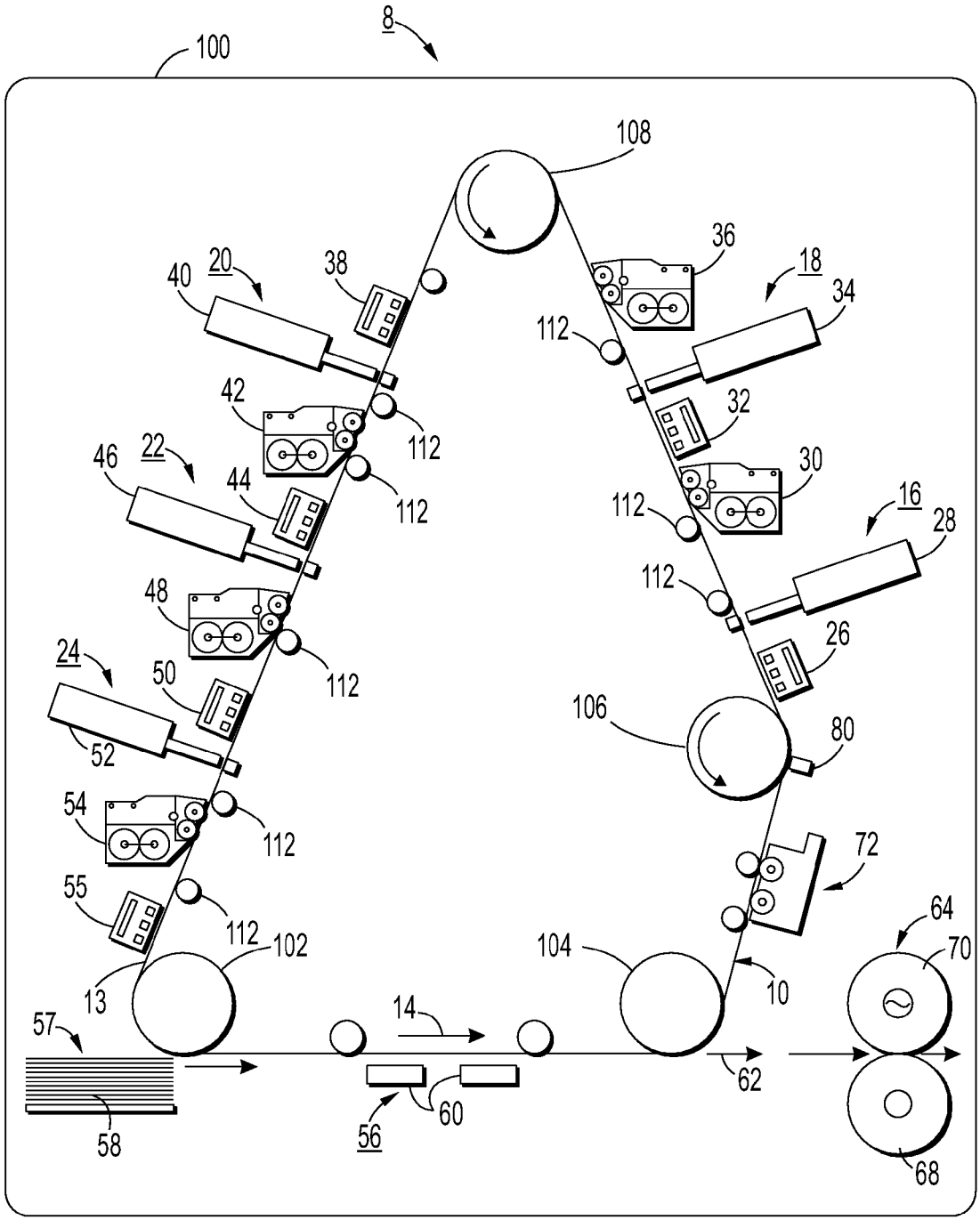
FIG. 1 is a typical marking system that can use the embodiments of the present invention.

In FIG. 1, there is shown the electrostatographic reproduction or marking machine of the present invention illustrated as a single pass multi-color electrostatographic reproduction machine 8. As shown, the machine 8 includes a media or paper assembly 57 for supplying and feeding toner image-carrying media such as copy sheets 58 through an image transfer station 56, and a fusing apparatus 64 that includes a pressure roll 68 and a heated fuser roll 70 for heating a fusing toner image to recording media 58.

Figure 3:
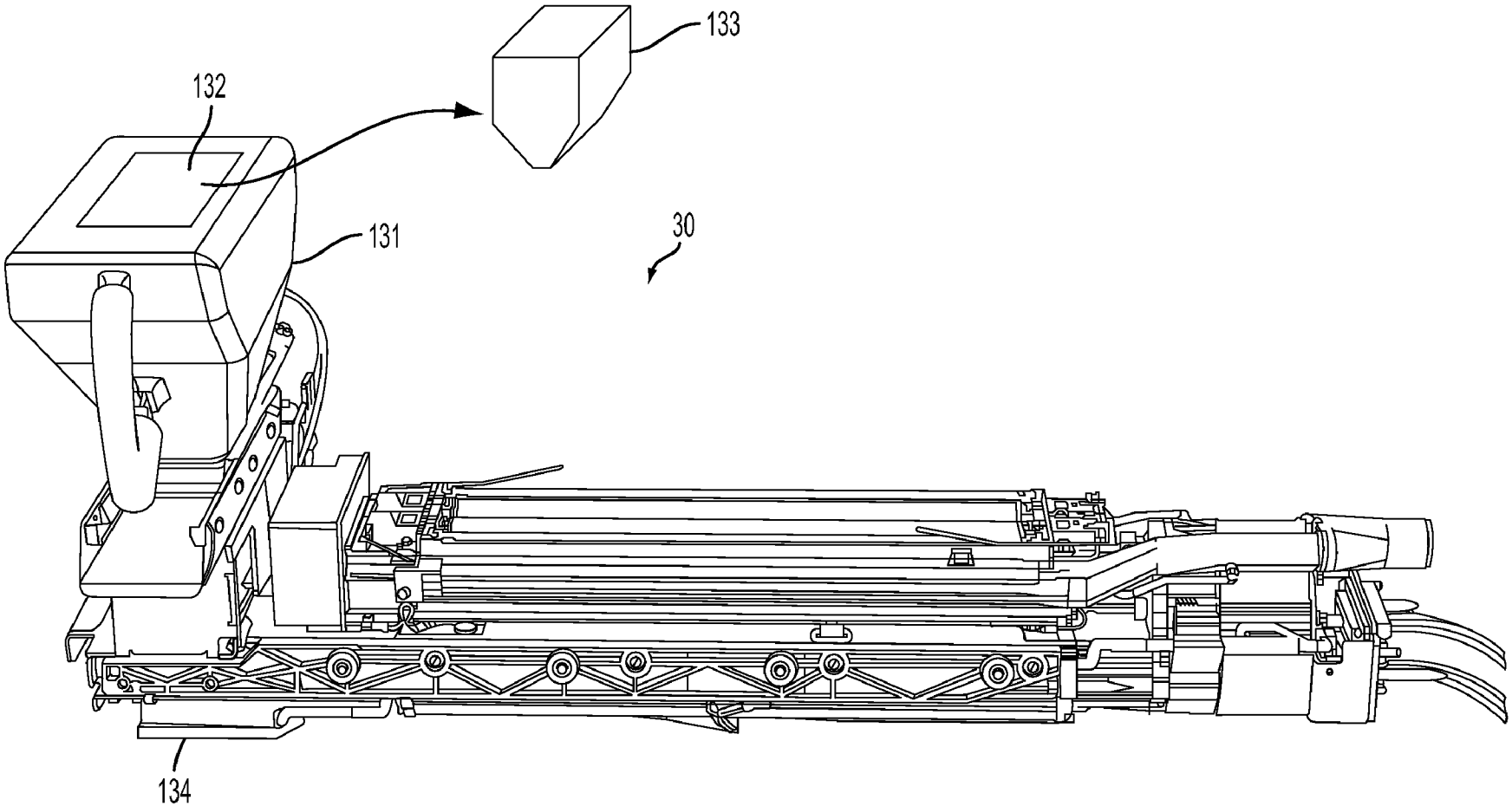
FIG. 3 illustrates a developer hardware unit or housing with a replaceable toner dispenser that is useful in this invention with a replaceable toner container.

As further shown, the machine 8 employs an endless image-bearing member or photoconductive belt 10 that has an imageable surface 13 for forming toner images thereon. A series of imaging devices as shown (to be described below) are located in image-forming relationship with the imageable surface 13 for forming toner images on the surface 13. Included in machine 8 are several developing units or housings designated at 30, 36, 40, 42, 48 and 54. FIG. 3 will designate the developing housing as element 30; however, any of the housings 30, 36, 40, 42, 48, and 54 are included.

As illustrated, the belt assembly or belt-moving and support assembly 100 comprises four (4) dominant rolls that include a drive roll 102, a sheet stripper roll 104, a moveable tensioning roll 106 and a moveable steering roll 108 of a steering assembly 110. The belt-moving and support assembly 100 also includes a series of skid backer bars 112 as shown. Referring again to the drawing of FIG. 1, the belt 10 is arranged in a generally vertical orientation and is driven by drive roll 102 to advance in the direction of arrow 14. As advance, successive portions of its external and imageable surface 13 are moved sequentially beneath various processing stations formed by the various imaging devices (as shown) disposed about the path of movement thereof. The various processing stations include five image recording stations indicated generally by the reference numerals 16,18, 20, 22 and 24, respectively.

Initially, belt 10 passes through image recording station 16. Image recording station 16 includes a charging device 26 and an exposure device 28. The charging device 26 is a corona generator that charges the exterior surface 13 of photoconductive belt 10 to a relatively high, substantially uniform potential. After the exterior surface of photoconductive belt 10 is charged, the charged portion thereof advances to the exposure device 28. The exposure device 28, for example, is a raster output scanner (ROS) which illuminates the charged portion of the exterior surface of photoconductive belt 10 to record a first electrostatic latent image thereon. Alternatively, a light-emitting diode (LED) may be used.

This first electrostatic latent image is developed by developer unit 30 which deposits liquid developer or toner particles of a selected highlight color on the first electrostatic latent image. After the highlight toner image has been developed on the exterior surface of photoconductive belt 10, belt 10 continues to advance in the direction of arrow 14 to image recording station 18.

Image recording station 18 includes a charging device and an exposure device. The charging device includes corona generator 32 which recharges the photoconductive surface to a relatively high, substantially uniform potential. The exposure device includes ROS 34 which illuminates the charged portion of the exterior surface of photoconductive belt 10 to selectively dissipate the charge thereon to record a third electrostatic latent image corresponding to the regions to be developed with yellow toner particles. This 2nd electrostatic latent image is now advanced to the next successive developer unit 36.

In one embodiment, developer unit 36 deposits magenta toner particles on the exterior surface of photoconductive belt 10 to form a magenta toner powder image thereon. These toner particles may be partially in superimposed registration with the previously formed highlight powder image. After the second electrostatic latent image has been developed with magenta toner, belt 10 advances in the direction of arrow 14 to the next image recording station 20.

Image recording station 20 includes a charging device and an exposure device. The charging device includes corona generator 38 which recharges the photoconductive surface to a relatively high, substantially uniform potential. The exposure device includes ROS 40 which illuminates the charged portion of the exterior surface of photoconductive belt 10 to selectively dissipate the charge thereon to record a third electrostatic latent image corresponding to the regions to be developed with yellow toner particles. This third electrostatic latent image is now advanced to the next successive developer unit 42.

In one embodiment, developer unit 42 deposits yellow toner particles on the exterior surface of photoconductive belt 10 to form a yellow toner powder image thereon. These toner particles may be partially in superimposed registration with the previously formed highlight and magenta, powder image. After the third electrostatic latent image has been developed with yellow toner, belt 10 advances in the direction of arrow 14 to the next image recording station 22.

Image recording station 22 includes a charging device and an exposure device. The charging device includes a corona generator 44 which charges the exterior surface of photoconductive belt 10 to a relatively high, substantially uniform potential. The exposure device includes ROS 46 which illuminates the charged portion of the exterior surface of photoconductive belt 10 to selectively dissipate the charge on the exterior surface of photoconductive belt 10 to record a fourth electrostatic latent image for development with cyan toner particles. After the fourth electrostatic latent image is recorded on the exterior surface of photoconductive belt 10, photoconductive belt 10 advances this electrostatic latent image to the magenta developer unit 48.

Cyan developer unit 48 deposits cyan toner particles on the fourth electrostatic latent image. These toner particles may be partially in superimposed registration with the previously formed highlight, magenta, and yellow powder image. After the cyan toner powder image is formed on the exterior surface of photoconductive belt 10, photoconductive belt 10 advances to the next image recording station 24.

Image recording station 24 includes a charging device and an exposure device. The charging device includes corona generator 50 which charges the exterior surface of photoconductive belt 10 to a relatively high, substantially uniform potential. The exposure device includes ROS 54 which illuminates the charged portion of the exterior surface of photoconductive belt 10 to selectively discharge those portions of the charged exterior surface of photoconductive belt 10 which are to be developed with black toner particles. The fifth electrostatic latent image to be developed with black toner particles is advanced to black developer unit 54.

At black developer unit 54, black toner particles are deposited on the exterior surface of photoconductive belt 10. These black toner particles form a black toner powder image which may be partially or totally in superimposed registration with the previously formed highlight, magenta, yellow and cyan toner powder images. In this way, a multi-color toner powder image is formed on the exterior surface of photoconductive belt 10. Thereafter, photoconductive belt 10 advances the multi-color toner powder image to a transfer station, indicated generally by the reference numeral 56.

At transfer station 56, a receiving medium, i.e., paper, is advanced from stack 58 by sheet feeders and guided to transfer station 56. At transfer station 56, a corona-generating device 60 sprays ions onto the back side of the paper. This attracts the developed multi-color toner image from the exterior surface of photoconductive belt 10 to the sheet of paper. Stripping assist roller 66 contacts the interior surface of photoconductive belt 10 and provides a sufficiently sharp bend thereat so that the beam strength of the advancing paper strips from photoconductive belt 10. A vacuum transport moves the sheet of paper in the direction of arrow 62 to fusing station 64.

Fusing station 64 includes a heated fuser roller 70 and a back-up roller 68. The back-up roller 68 is resiliently urged into engagement with the fuser roller 70 to form a nip through which the sheet of paper passes. In the fusing operation, the toner particles coalesce with one another and bond to the sheet in image configuration forming a multi-color image thereon. After fusing, the finished sheet is discharged to a finishing station where the sheets are compiled and formed into sets which may be bound to one another. These sets are then advanced to a catch tray for subsequent removal therefrom by the electrostatographic reproduction machine operator.

Invariably, after the multi-color powder image has been transferred to the sheet of paper, residual toner particles remain adhering to the exterior surface of photoconductive belt 10. The photoconductive belt 10 moves over isolation roller 78 which isolates the cleaning operation at cleaning station 72. At cleaning station 72, the residual toner particles are removed from photoconductive belt 10. The belt 10 then moves under spots blade 80 to also remove toner particles therefrom. It is, therefore, apparent that there has been provided in accordance with a system usable in the present invention, an electrostatographic reproduction machine including a media assembly for supplying and moving toner image receiving media past a toner image transfer device; a fusing apparatus for heating and fusing a toner image on the toner image receiving media; and an imaging assembly for forming and transferring a toner image onto the toner image receiving media. The imaging assembly includes an endless photoreceptor belt having an imageable surface for forming the toner image developed at CCUs 30, 36, 40, 42, 48 and 54. This marking system is illustrative of the systems that can use the present invention.

Obviously, it is not the only marking system usable; any other suitable marking system having color development stations may be used.

Figure 2:
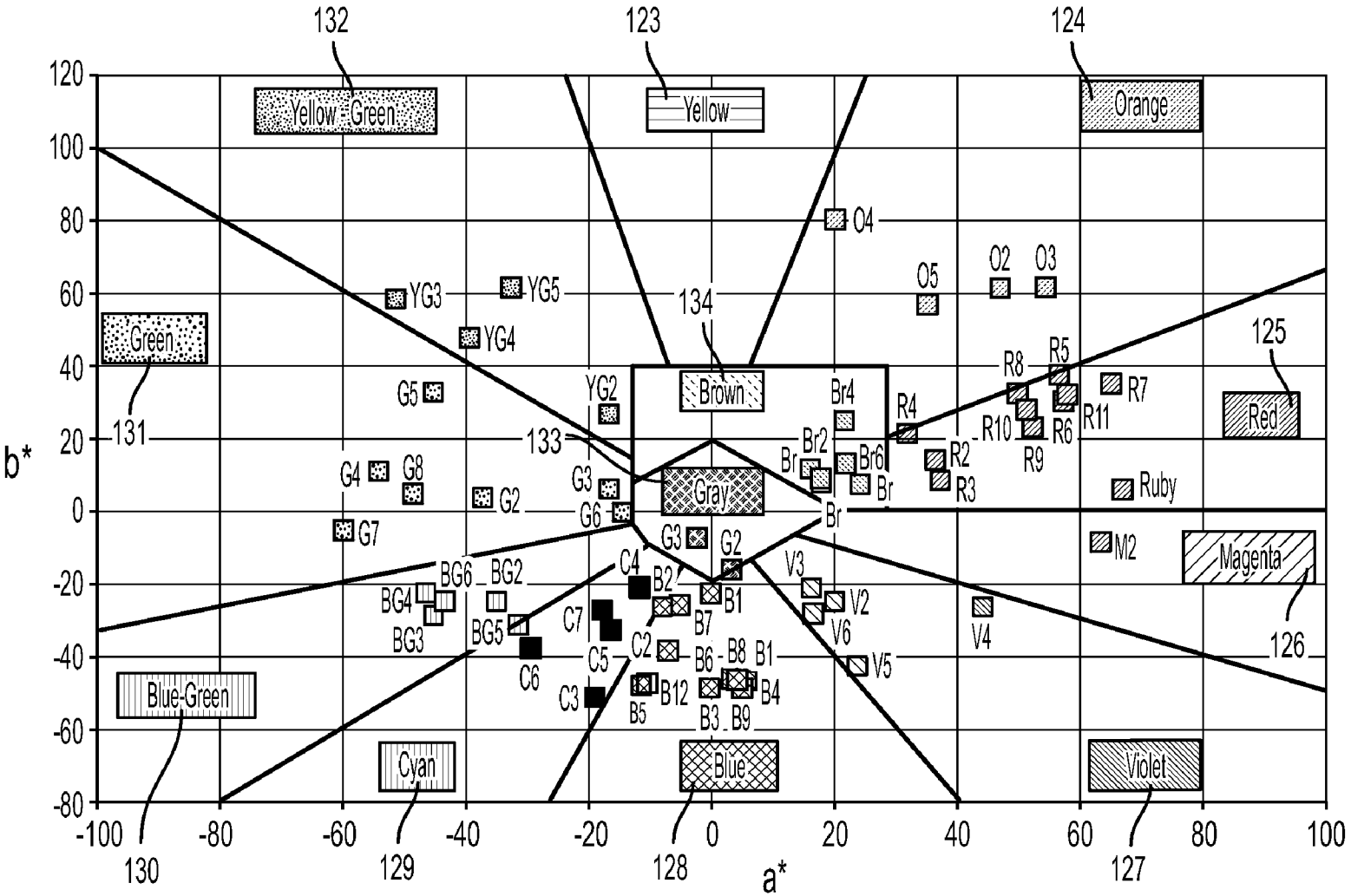
FIG. 2 illustrates a chart that directs a user on how to use the present invention.

In FIG. 2, twelve (12) quadrants or color families are illustrated. However, any suitable number of quadrants (sections) can be used. FIG. 2 has quadrants or color families which are yellow 123, orange 124, red 125, magenta 126, violet 127, blue 128, cyan 129, blue-green 130, green 131, yellow-green 132, gray 133 and brown 134.

In FIG. 2, for purposes of describing an embodiment of the present invention, color change algorithms are left generic (any process to convert hardware from color a to b). The color space has been divided into 12 quadrants, sections or color families (more or less may be required). The chart in FIG. 2, is used to describe the toner color to be used in each quadrant. Each square □ represents a different color within its family, i.e. 02 is an orange color different in intensity from 05 but within the same color family—orange. (See FIG. 2)

For example, shown in FIG. 2, the customer could be running color 02 (orange 2) then decide at a later date that they need 04 (orange 4). The customer already knows that if they have an orange-designated housing that can "upgrade" to the orange 4, they are not required to purchase additional hardware. The customer would remove the orange 2 bottle and execute a routine that empties the toner dispenser. The new color orange 4 is installed and the algorithm executes until the correct color is achieved. The algorithms are not defined but are generic detone and retone routines that run until enough of the orange 2 toner is purged and the customer accepts the color. A spectrophotometer may be used to confirm the new color desired by the customer. Obviously, while a spectrophotometer is highly preferred, visual inspection can also be used, if suitable, to confirm the new color.

The customer runs a special diagnostic routine that affects the color change by (1) setting the machine control switches such that some of the xerographic process controls are turned off, (2) instructs the customer to install the new toner bottle and enter the toner color, (3) checks the old vs. new toner colors to insure compatibility with the exchange process, (4) runs a high area coverage canned image to reduce the toner concentration to less than 1% tc, and (5) tones up the housing using the new color to a nominal tc (say 6%). Assuming the system started at 6% with the old color, this process is 83% effective in replacing the color. Steps 4 and 5 are repeated driving the new toner to a concentration of 97.22% (35 parts in 36). If needed, steps 4 and 5 can be repeated again to drive the new toner to a concentration of 99.53% (215 parts in 216). Each iteration uses ~125 grams of new toner for a developer sump size of 2500 grams which can vary depending on the system The purged toner is sent to the cleaner or printed to paper and discarded.

In FIG. 3 a developer housing useful in the present invention is illustrated. Many specifics of this housing 30 are not necessary to describe in detail for purposes of this invention. It contains a toner dispenser 131 which will house a replaceable toner container in housing 132. When a color is to be changed, the old toner container 133 removed from housing 132 and is replaced by a new toner container. The toner is dispenses from toner outlet 134 when the marking system 8 is in use. Rather than requiring the customer to replace the entire developer housing 30 as in prior art color systems, the customer in the present invention only needs to change color containers or bottles 133. As earlier noted, the developer housing 30 is relatively expensive to replace.

The customer can change colors within a certain area without the added expense of a new developer housing 30 and toner dispense system 131. This will increase the number of custom colors and provide the customer with the flexibility of quickly changing colors. The customer also would only need to maintain a maximum of 12 housings for any number of colors. The process will use more of the customer's toner. It will use enough so that the customer won't be doing daily color changes in a single housing. The toner that is left in the toner dispense system 131 is close to 0.5 pounds (can be more or less, depends on dispenser volume) which is cheaper than the current need of new, expensive housing, toner dispense and CCU cart. The customer will need significantly less floor space for the CCU carts including housing 30 and toner dispenser 131. Also, the customer only will need to order new toner if the color falls within the gamut of existing housing; ordering a new housing 30 will no longer be required. Increased customer satisfaction allows the customer to go after smaller jobs because it is not necessary to offset the CCU 30 cost as previously stated. The field service organization will need to maintain significantly less developer hardware 30 in the customer site, the color change will not generate a service color (now handled by the customer) and increased page volumes enable the customer to go after smaller jobs with different colors.

It will be appreciated that variations of the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims.

What is claimed is:

1. A method of changing a color developer in a developer housing of xerographic marking system which comprises:

supplying a chart divided into a plurality of color family sections or quadrants, selecting a new color to be installed in a developer housing corresponding to the color family section, purging old toner from said developer housing until a concentration of old toner is reduced to about 0.1% to 6.0% from its nominal concentration, installing a container of a new color developer in said developer housing, and running said marking system until the required concentration of said new color developer is attained.

2. The method of claim 1 wherein said old developer and said new color developer are in the same color family.

3. The method of claim 1 wherein said old toner in developer is reduced to a concentration of less than 1.0%.

4. The method of claim 1 wherein said old toner in developer is reduced to a concentration of less than 6.0%.

5. The method of claim 1 wherein said new color developer is measured by a spectrophotometer to ensure a required color.

6. The method of claim 1 wherein a required new color developer is measured by visual inspection.

7. A method of changing a color developer in a developer housing of a xerographic color-marking system, said system comprising a plurality of color stations which comprises:

dividing at least one developer housing into a plurality of quadrants or sections, each section of a same color family, supplying a chart divided into the same sections as said developer housing, selecting a new color developer to be installed within said at least one developer housing to replace an old color developer within said same color family, removing old toner from said developer housing, purging any said old toner from said developer housing until a remaining concentration of said old toner is reduced to a concentration of about 0.1% to 6.0%, installing a container of said new toner in said developer housing, and running said marking system with said new toner until the desired new color is obtained.

8. The method of claim 7 wherein said old developer and said new color developer are in the same color family.

9. The method of claim 7 wherein said old toner is reduced to a concentration of less than 1.0%.

10. The method of claim 7 wherein said old toner is reduced to a concentration of less than 6.0%.

11. The method of claim 7 wherein said new color developer is measured by a spectrophotometer to ensure a required color.

12. The method of claim 7 wherein a required new color developer is measured by visual inspection.

13. The method of claim 7 wherein said system comprises at least 1 color station.

14. The method of claim 7 wherein said system comprises 1 or more different color stations.

* * * * *